US010472765B2

(12) United States Patent
Kirth et al.

(10) Patent No.: US 10,472,765 B2
(45) Date of Patent: Nov. 12, 2019

(54) ROPE MADE OF TEXTILE FIBER MATERIAL

(71) Applicant: TEUFELBERGER FIBER ROPE GMBH, Wels (AT)

(72) Inventors: Rudolf Kirth, Vöcklabruck (AT); Björn Ernst, Linz (AT); Erich Rührnössl, Haid (AT); Robert Traxl, Ebensee (AT); Peter Baldinger, Schwertberg (AT); Gunter Kaiser, Thalheim/Wels (AT)

(73) Assignee: TEUFELBERGER FIBER ROPE GMBH, Wels (AT)

( * ) Notice: Subject to any disclaimer, the term of this patent is extended or adjusted under 35 U.S.C. 154(b) by 370 days.

(21) Appl. No.: 15/524,569

(22) PCT Filed: Oct. 28, 2015

(86) PCT No.: PCT/EP2015/075032
§ 371 (c)(1),
(2) Date: May 4, 2017

(87) PCT Pub. No.: WO2016/071184
PCT Pub. Date: May 12, 2016

(65) Prior Publication Data

US 2017/0328001 A1 Nov. 16, 2017

(30) Foreign Application Priority Data

Nov. 5, 2014 (AT) ..... A 50808/2014

(51) Int. Cl.
*D07B 1/02* (2006.01)
*D07B 1/08* (2006.01)
(Continued)

(52) U.S. Cl.
CPC ..... *D07B 1/08* (2013.01); *B66B 7/06* (2013.01); *D07B 1/025* (2013.01); *D07B 1/0633* (2013.01);
(Continued)

(58) Field of Classification Search
CPC ..... D07B 2201/10; D07B 2201/20; D07B 2201/1012; D07B 2201/2001;
(Continued)

(56) References Cited

U.S. PATENT DOCUMENTS 4,022,010 A 5/1977 Gladenbeck et al.
4,095,404 A 6/1978 Babayan
(Continued)

FOREIGN PATENT DOCUMENTS

CN 201605478 U 10/2010
DE 7438919 U 8/1975
(Continued)

OTHER PUBLICATIONS

W E Brown, "Friction Coefficients of Synthetic Ropes", Feb. 1, 1977, XP055233876.
(Continued)

*Primary Examiner* — Tajash D Patel
(74) *Attorney, Agent, or Firm* — Workman Nydegger

(57) ABSTRACT

The invention relates to a rope (1) made of textile fibre material, which is characterized by the combination of features whereby a) the load-bearing fibre material of the rope (1) consists of high-strength synthetic fibres
b) the rope (1) is in the form of a spiral strand rope
c) the rope (1) has at least two, preferably at least three concentric load-bearing strand layers (3,4,5)
d) the individual strands (7,8,9,10,11,12) of the strand layers (3,4,5) are movable with respect to one another
(Continued)

e) the degree of filling of the rope (1) with textile fibre material is ≥75%, preferably ≥85% f) the outermost ply (5,6) of the rope has a coefficient of friction μ with respect to steel of μ<0.15.

13 Claims, 4 Drawing Sheets

(51) Int. Cl.

| | |
|---|---|
| ***D07B 5/00*** | (2006.01) |
| ***B66B 7/06*** | (2006.01) |
| ***D07B 1/06*** | (2006.01) |
| ***D07B 1/16*** | (2006.01) |
| *D07B 5/12* | (2006.01) |

(52) U.S. Cl.

CPC ..... *D07B 1/162* (2013.01); *D07B 5/005* (2013.01); *D07B 5/006* (2015.07); *D07B 5/007* (2013.01); *D07B 5/12* (2013.01); *D07B 2201/108* (2013.01); *D07B 2201/1016* (2013.01); *D07B 2201/1036* (2013.01); *D07B 2201/1084* (2013.01); *D07B 2201/209* (2013.01); *D07B 2201/2044* (2013.01); *D07B 2201/2087* (2013.01); *D07B 2201/2089* (2013.01); *D07B 2205/205* (2013.01); *D07B 2205/2014* (2013.01); *D07B 2205/2042* (2013.01); *D07B 2205/2096* (2013.01); *D07B 2401/2015* (2013.01); *D07B 2401/2055* (2013.01); *D07B 2501/2007* (2013.01); *D07B 2501/2015* (2013.01); *D07B 2801/24* (2013.01)

(58) Field of Classification Search

CPC ..... D07B 2201/209; D07B 2401/20; D07B 2401/2085; D07B 1/025; D04C 1/04; D04C 1/06; D04C 3/12; D04C 3/40

See application file for complete search history.

(56) References Cited

U.S. PATENT DOCUMENTS

| | | | | |
|---|---|---|---|---|
| 7,784,258 | B2 * | 8/2010 | Hess | D07B 1/02 57/210 |
| 7,908,955 | B1 | 3/2011 | Chou et al. | |
| 9,845,571 | B2 * | 12/2017 | Kirth | D04C 3/40 |
| 2003/0226347 | A1 | 12/2003 | Smith et al. | |
| 2006/0086415 | A1 | 4/2006 | Eichhorn | |
| 2009/0217640 | A1 | 9/2009 | Bloch | |
| 2012/0160082 | A1 | 6/2012 | Erlendsson | |
| 2012/0260620 | A1 | 10/2012 | Kim et al. | |
| 2013/0264093 | A1 | 10/2013 | Fontana et al. | |

FOREIGN PATENT DOCUMENTS

| | | | |
|---|---|---|---|
| DE | 2853661 | C2 | 7/1980 |
| DE | 29816936 | U1 | 12/1998 |
| DE | 202010005730 | U1 | 9/2010 |
| DE | 202010006145 | U1 | 9/2010 |
| DE | 102009056068 | | 6/2011 |
| DE | 202011001845 | U1 | 6/2011 |
| DE | 202011001846 | U1 | 6/2012 |
| EP | 0117122 | A1 | 8/1984 |
| EP | 0252830 | B1 | 1/1988 |
| EP | 0672781 | B | 9/1995 |
| EP | 0731209 | A1 | 9/1996 |
| EP | 0934440 | B | 8/1999 |
| EP | 0995832 | B | 4/2000 |
| EP | 1004700 | B | 5/2000 |
| EP | 1010803 | B | 6/2000 |
| EP | 1111125 | A1 | 6/2001 |
| EP | 1371597 | A1 | 12/2003 |
| EP | 1461490 | A1 | 9/2004 |
| EP | 1657210 | A1 | 5/2006 |
| EP | 1930496 | A2 | 6/2008 |
| EP | 1930497 | | 6/2008 |
| EP | 1930497 | B | 5/2012 |
| EP | 2518208 | A2 | 10/2012 |
| GB | 2036825 | A | 7/1980 |
| GB | 2152088 | A | 7/1985 |
| JP | H01266289 | A | 10/1989 |
| WO | WO2005019525 | A1 | 3/2005 |
| WO | WO2008129116 | A1 | 10/2008 |
| WO | WO2009026730 | A1 | 3/2009 |
| WO | WO2012146380 | A2 | 11/2012 |

OTHER PUBLICATIONS

Feyrer, Drahtseile. Bemessung, Betrieb, Sicherheit. Springer Verlag, Berlin, Heidelberg, New York, 2000, S. 115.

Lubricants for Ropes, Research Disclosure, Mason Publications, Hampshire, GB, Nr. 214, Feb. 1, 1982, XP001066432.

* cited by examiner

ROPE MADE OF TEXTILE FIBER MATERIAL

The invention relates to a rope made of textile fibre material as well as to its use.

Ropes made of textile fibre material, for example synthetic fibre ropes, are used for numerous applications. Due to several advantages, high-strength fibre ropes have meanwhile become superior to steel ropes, which were previously used and, respectively, available exclusively, especially in the field of materials handling.

In the elevator technology, wherein the actuation is effected via traction sheaves, the advantages of the high-strength fibre rope consist in that the drives can operate with a smaller ratio of the traction sheave diameter to the rope diameter than in steel ropes, since fibre ropes, unlike steel ropes, allow this without any major drawbacks such as, for example, a loss of service life. This results in the possibility of using smaller installation sizes for the traction sheave drives, thereby leading to space and cost savings.

Furthermore, a high-strength fibre rope has a weight which, depending on the fibre material, is 4 to 6 times lighter than that of a steel rope, which has a favourable effect especially in case of large elevating heights. Besides, in high-strength fibre ropes, allowable numbers of reversed bending stresses which are many times higher can be achieved by appropriate measures, resulting in a longer operating time, i.e., service life, of the rope in comparison to steel ropes.

For the elevator technology, the development of those ropes has been directed specifically at an ideal traction sheave drive with a coefficient of friction as high as possible between the traction sheave and the hoist rope. Known elevator fibre ropes are designed in diverse structures, wherein, in most cases, they exhibit a sheathing of the strands and a synthetic sheathing of the complete rope. The strength of the sheathing is configured such that it will permanently withstand the stresses produced during the run over rope pulleys and particularly traction sheaves.

Such high-strength fibre ropes are known for their use in traction sheave elevator drives and, for example, from EP 0 672 781 B and EP 0 934 440 B.

For hoisting applications in lifting technology, for example tower slewing cranes, mobile cranes, crawler cranes etc., drum drives comprising rope drums with windings in several layers are used rather than traction sheave drives. Compared to traction sheave drives, drum drives have the additional benefit of being able to store the rope length which is not required in a controlled and ordered manner. This is not the case with a traction sheave drive, since, in the elevator technology, the complete rope length between the elevator car and the counterweight is used and, hence, a storing function is not necessary. Furthermore, drum drives used in lifting technology have a significantly higher hoisting potential than traction sheave drives.

For the operation on a drum drive with windings in several layers, a failure-free and stable drum winding ("winding pyramid") of a controlled structure across all rope layers is of fundamental significance. A failure-free drum winding is understood to be a winding without gaps ("spacing") between adjacent rope windings of the same winding layer ("winding jump"), without the rope cutting into the underlying winding layers and without the rope rising at the flange outside of the rising zones intended therefor. A stable drum winding is understood to be a minor deformation of the winding package under load for the duration of the operation.

However, ropes of a making and design as known for the traction sheave drive are unsuitable for a multilayered winding on drums, since damage to the rope will be caused by the winding within a short period of time. Thereby, major cross-sectional deformations of the rope placed on the drum will occur in the multilayered winding, if, in addition to the longitudinal loading, said rope is also loaded radially by layers placed thereupon under load. Those cross-sectional deformations result in significantly increased material wear and in errors in the winding pattern, since the upper rope layers cannot support themselves in an ordered manner on the lower rope layers, which have been deformed under a radial load.

Furthermore, in fibre ropes, the high coefficient of friction of the rope surface as required for traction sheave drives has an additional negative effect in the multilayered winding, since, in the multilayered winding, rope is wound over rope and, if changes occur in the tensile force of the rope, i.e., when a load is being picked up or set down, rope will slide on rope. As a result of the high friction and the strain caused by the multilayered winding, the sheathing of the rope will crack and become loose very quickly, and the rope must be placed down.

For the use in drive pulleys and rope drums, EP 0 995 832 B suggests a rope made of aramide fibres which consists of at least two strand layers which are twisted into the spiral rope, wherein the individual strand layers are separated from each other by an intermediate layer and the outer strand layer is stranded with the inner strand layer adjacent to it in the opposite lay direction. The lay ratio of the crosslay stranding ranges from 1.5 to 1.8.

According to EP 1 010 803 B, the different strand layers of a synthetic fibre rope are aligned with each other such that their torques directed against each other will cancel each other out.

From EP 1 930 497 B, a synthetic fibre rope is known which is equipped with a bi-layered rope sheath in different colours so that the degree of wear of the rope can be inspected visually.

EP 1 004 700 B describes a synthetic fibre rope comprising several strand layers, wherein the strands of the outermost layer are surrounded by a coating for protection against abrasion and damaging environmental influences.

In U.S. Pat. No. 4,022,010, a high-strength synthetic fibre rope is described which consists of at least one core component made of an elastic synthetic material and twisted high-strength synthetic fibres encasing the core, with the core being pre-stretched and the core and the fibres being impregnated with an abrasion-resistant synthetic material.

EP 0 252 830 B1 describes a synthetic fibre rope which has a central radially elastic core. The rope is impregnated throughout, as far as into the interior of the yarns, with a binding agent.

Further prior art is known from the documents DE 202011001846 U1, DE 202001001845 U1, DE 20 2010006145 U1, WO 2009/026730 A1, DE 202010005730 U1, EP 0 731 209 A1, EP 1 930 496 A2, GB 2 152 088 A, DE 2 853 661 C2, EP 1 111 125 A1, EP 1 461 490 A1, EP 1 657 210 A1, EP 1 930 497 A1, EP 1 371 597 A1, EP 0 117 122 A1, WO 2012/146380 A2, U.S. Pat. No. 4,095,404 A, US 2003/226347 A1, US 2006/086415 A1, U.S. Pat. No. 7,908,955 B1, US 2012/160082 A1, WO 2005/019525 A1, JP H01266289 A, DE 10 2009056068 A1, US 2012/260620 A1 and WO 2008/129116 A1.

The invention has as its object to provide a rope made of textile fibre material for lifting applications which can be used with drum drives and overcomes the above-mentioned disadvantages of the prior art. In particular, the rope is supposed to exhibit a service life and a load carrying capacity comparable to those of steel ropes.

According to the invention, said object is achieved by a rope made of textile fibre material having the features indicated in claim 1. Preferred embodiments are set forth in the subclaims.

SHORT DESCRIPTION OF THE FIGURES

Figure 4:
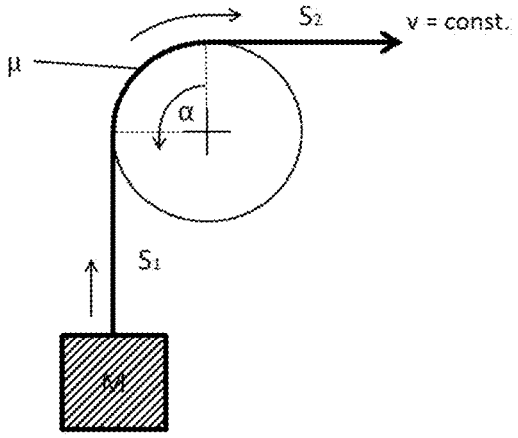

FIG. 4 schematically shows an equipment for determining the coefficient of friction.

DETAILED DESCRIPTION OF THE INVENTION

It has been found that a rope made of textile fibre material having the combination of features as described in claim 1 is perfectly suitable for solving the initially described problems associated with rope applications involving a drum drive.

In this connection, the term "rope made of textile fibre material" means that the essential components of the rope, in particular its load-bearing elements, consist of a textile fibre material such as, e.g., strands of synthetic fibres. The rope according to the invention may also comprise components of other materials such as, for example, a core made of a non-textile material, a sheath made of a non-textile material, materials impregnating the rope or rope components or else individual non-textile strands of a specific function, e.g., for transmitting electrical signals.

Preferably, the entire rope, both with regard to load-bearing and non-load-bearing components, consists of a textile fibre material.

The rope according to the invention is characterized by the combination of the following features:

a) the load-bearing fibre material of the rope consists of high-strength synthetic fibres b) the rope is in the form of a spiral strand rope c) the rope has at least two, preferably at least three concentric load-bearing strand layers d) the individual strands of the strand layers are movable with respect to one another e) the degree of filling of the rope with fibre material is ≥75%, preferably ≥85% f) the outermost ply of the rope has a coefficient of friction $\mu$ with respect to steel of $\mu<0.15$.

It has been shown that ropes with this combination of features show a very good stability against the requirements, in particular in applications involving a drum drive.

The high-strength fibre rope described herein exhibits optimal conditions for a multilayered winding of drums in rope drives, in particular for applications in which steel ropes have been used so far. Moreover, the rope according to the invention meets all the requirements with regard to a high fatigue strength under reversed bending stresses and a high breaking force, in addition to the optimal conditions for the multilayered winding of drums.

Comparative tests with commercially available steel ropes under identical conditions (such as, for example, on the test bench as per publication no.: WO 2012/146 380) have shown that the rope according to the invention exhibits a significantly higher rope service life, in comparison to the steel rope and other conventional fibre ropes.

As regards the individual features:

Feature a)

The load-bearing fibre material of the rope according to the invention consists of high-strength synthetic fibres. For the purposes of the present invention, fibres having a tensile strength of at least 14 cN/dtex, preferably a tensile strength of more than 24 cN/dtex, particulary preferably of more than 30 cN/dtex, are understood as "high-strength". For example, UHMWPE fibres (Dyneema®), aramide fibres, LCP fibres and PBO fibres are known as high-strength fibre types of appropriate tensile strengths. Preferably, the entire load-bearing fibre material of the rope consists of UHMWPE fibres.

A "load-bearing fibre material" is understood to be that part of the fibre material of the rope which contributes to the absorption of tensile forces emerging during the application of the rope.

Features b) and c)

The rope according to the invention is in the form of a spiral strand rope. To that end, the textile fibre material is at first laid, twisted or braided into a strand. Several of those strands are twisted with each other in several layers to form a rope. Relative to each other, the strand layers can consist of different fibre materials and can have different diameters, different strand numbers, different lay directions as well as different lay angles. Different fibre materials and strands of different diameters can also be provided within the individual strand layers.

In particular, the rope according to the invention has at least two, preferably at least three concentric load-bearing strand layers. Therein, the respective outermost strand layer preferably exhibits the lay direction which is opposite to the lay direction of the interior strand layers.

"Load-bearing strand layers" are understood to be such that the strand layers in their entirety contribute to the absorption of tensile forces emerging during the application of the rope. Of course, one strand layer can include strands which, considered on their own, are not designed so as to be load-bearing. Similarly, one strand, even if its action is load-bearing, may partly include materials which do not act in a load-bearing fashion.

Feature d)

The individual strands of the strand layers are movable with respect to one another. From the prior art for ropes in traction sheave applications, it is known (e.g., EP 0 995 832) to fill the spaces between the strands and strand layers with an elastically deformable intermediary material. Thereby, the individual strands and strand layers, respectively, are not movable with respect to one another. It has been found that this arrangement is disadvantageous in particular for applications involving a drum drive and mutual movability of the strands and strand layers, respectively, with respect to one another will increase the stability of the rope.

Feature e)

The degree of filling of the rope with textile fibre material is ≥75%, preferably ≥85%. It has been shown that a high degree of filling of the rope with fibre material, i.e., a very compact arrangement of the fibre material, is per se important in regard to the solution of the above-described problems in the application and in regard to the service life of the rope.

The degree of filling of the rope with textile fibre material is determined by the measuring method described below in detail. It comprises all load-bearing and non-load-bearing textile elements of the rope, for example, also a core made of textile fibre material or a sheath made of textile fibre material.

Conventional fibre ropes exhibit a degree of filling with textile fibre material of up to 60%. In particular as a result of the design of the rope as a spiral strand rope as described herein and further features described hereinbelow, very high degrees of filling of 75% and more or, respectively, even of 85% and more can be achieved in the rope according to the invention.

In addition, the rope according to the invention has a low content of non-textile binding and impregnating agents. Said content is 10% by weight or less, preferably 5% by weight or less, always based on the total mass of the rope.

Feature f)

The outermost ply of the rope according to the invention has a coefficient of friction$\mu$ with respect to steel of $\mu<0.15$.

For ropes for applications involving a traction sheave drive, it is known that the outermost ply of the rope (in particular a sheath) has a high coefficient of friction in order to allow the appropriate frictional connection with the drive wheel.

According to the invention, it has been shown that, for applications in particular involving a drum drive, a low coefficient of friction of the outermost ply of the rope with respect to steel is favourable. A sheath surrounding the rope or, if no sheath is provided, the outermost strand layer is to be regarded as the outermost ply of the rope.

The coefficient of friction of the outermost ply with respect to steel is determined according to the measuring method indicated below.

In a preferred embodiment of the present invention, the rope is surrounded by a sheath, wherein, as illustrated above, the sheath surrounding the rope has a coefficient of friction $\mu$ with respect to steel of $\mu<0.15$.

The spiral strand rope according to the invention is protected by the sheath against external influences such as abrasion, penetration of particles, ultraviolet radiation etc.

Said sheath can consist of textile fibre material, but also of other materials, and can be wound, laid, braided or extruded. The low coefficient of friction of the sheath ensures very good sliding properties in the multilayered winding.

In a further preferred embodiment of the rope according to the invention, the strand layers are aligned with each other such that the rope is essentially non-twisting under load.

According to Feyrer, Drahtseile. Bemessung, Betrieb, Sicherheit. Springer Verlag, Berlin, Heidelberg, New York, 2000, p. 115, a rope is regarded as non-twisting, if, during a tensile load of $S/d^2=0$ N/mm$^2$ to $S/d^2=150$ N/mm$^2$, the angle of twist per rope length remains smaller than $\leq\pm360°/1000d$.

The stability of the rope against twisting during operation is important. Due to the helix shape of the strands in the rope, which is caused by the laying process, each strand layer develops a torque under a tensile load. According to the preferred embodiment, the strand layers of the rope according to the invention are aligned with each other with regard to diameters, cross-sectional proportions and lay angles in such a way that the strand torques will cancel each other out under load and the spiral strand rope will become torque-free in this manner.

A further preferred embodiment of the rope according to the invention is characterized in that the ratio of the length of lay of one of the strand layers to the length of lay of the strand layer adjacent in the direction of the rope centre is less than 1.5, preferably 0.7 to 1.0, particularly preferably 0.8 to 0.9.

From the prior art of fibre ropes for applications involving a traction sheave drive, it is known (e.g., EP 0 995 832) to make sure that the length of lay of a strand layer is in each case considerably larger than the length of lay of the underlying strand layer, particularly at a ratio of 1.5 or more.

In contrast, it has been found according to the invention that it is advantageous if the ratio of the length of lay of at least one of the strand layers to the length of lay of the strand layer adjacent in the direction of the rope centre is less than 1.5, preferably 0.7 to 1.0, particularly preferably 0.8 to 0.9. This applies in particular to the ratio of the length of lay of the outermost strand layer to the adjacent inner strand layer. A structure of the rope with three strand layers, wherein the ratio of the length of lay of the outermost strand layer to the central strand layer is 1.0 or less, is particularly preferred. In said embodiment, the ratio of the length of lay of the central strand layer to the innermost strand layer may range from 1.0 to 2.0.

As illustrated above, the rope according to the invention has a high degree of filling with textile fibre material. The high degree of filling can be achieved by the design of the rope as a spiral strand rope as described as well as, in addition, by one or several of the following features:

The fibre material of the rope can be compacted, for example by milling, rolling, hammering.

Preferably, the fibre material of the rope can be stretched by more than 15% of its breaking force, particularly preferably by 35% to 55% of its breaking force.

The fibre material of the rope can be subjected to a thermal treatment, wherein the fibre material is heated to a defined temperature for a defined period of time and subsequently is cooled down in a defined way. Said process can also be performed several times.

In all three variants which are described (which can be applied individually or in combination), the described measures can be taken in each case on the entire finished rope (with or without sheath), on the individual strands of the rope and/or else on the materials constructing the strands, such as yarns or, respectively, twines.

Due to the described measures, settlement effects, which occur later during operation, are anticipated and in particular the degree of filling is significantly increased, since the fibres abut each other ideally and cavities as they inevitably emerge during stranding are eliminated.

Furthermore, the actual breaking force is significantly increased, since length and bearing load differences between the individual strands and fibres are homogenized.

In a further preferred embodiment of the present invention, the load-bearing strands of the rope are each provided individually with a sheathing. The yarns constructing the strand can also be surrounded by an encasing layer, individually or in groups. Said strand-encasing layer may consist, for example, in a winding, a braiding, a laying or an extruded layer and protects the strands against stress during the operation of the rope.

Furthermore, by selectively adding auxiliary materials based, for example, on bitumen and/or silicone during the production of the high-strength fibre rope, the coefficients of friction between fibres and strands as well as the spiral strand rope and the protective sheath can be adjusted selectively and the stability against stress during the operation of the rope can be increased further.

A further aspect of the present invention relates to the use of the rope according to the invention as a load rope for applications involving a drum drive. In particular, the rope according to the invention is perfectly suitable as a hoist rope, an adjustment rope or a pull rope.

The rope according to the invention can have a diameter of 6 mm to 200 mm and more.

Preferred embodiments of the present invention are illustrated hereinbelow on the basis of the figures.

Measuring Methods

Degree of Filling

Prior to the determination of the degree of filling, the following is to be determined:

the actual rope diameter d the actual rope weight m of textile fibre material

Rope Diameter

The determination of the rope diameter d is effected in the tension-free state on three diameter levels each spaced apart by 100 mm and always in two directions which are perpendicular (90°) to each other. If the cross-section of the rope is not circular, the maximum and the minimum diameters are to be determined in each section. During the measurement, the cross-section of the rope may not be subjected to a deformation.

The rope diameter d is to be determined and to be used with an accuracy of at least 0.01 mm as an arithmetic mean of the six measurands.

Rope Weight m

The determination of the rope weight m is to be performed and to be used according to ISO 2307:2010, 9.8 "Fineness/Linear Mass".

For the reference tension (ISO 2307:2010 Annex A), always the nominal diameter next in size in the table is to be used.

The conditioning as per ISO 2307:2010, 8 must be fulfilled.

Non-textile components, which are possibly present, are to be removed.

Density ρ

For the purposes of the present invention, the density ρ of the textile rope material is determined to be 1.4 g/cm$^3$.

The degree of filling is to be determined as follows:

$$f=\{m/[(\pi*d^2/4)*1.4\text{g/cm}^3]\}*100$$

with f=degree of filling in % m =specific rope weight of the textile components in g/m, determined according to ISO 2307:2010, 9.8 d rope diameter in mm

Coefficient of Friction

Measuring device:

The rope is pulled across a stationary metal disc with a flat surface (no groove formation). The disc is entrained more or less strongly by the friction of the rope to be examined. The disc is fixated, a load cell measures the force which is caused by the entrainment through the rope to be examined. The measuring device is depicted schematically in FIG. 4.

The surface of the disc must be designed flat (no groove formation) and may exhibit a maximum mean surface roughness of $R_A \geq 0.2$ μm.

Measuring Method

Prior to each test, the disc surface must be cleaned with alcohol.

The rope is clamped on the pull side.

The rope is charged with a constant load M on the load side.

The rope must rest centrally on the disc.

The measuring device is tared to 0.

The rope is pulled off on the pull side at a constant speed of v=0.05 m/s.

The constant tensile load S2 appearing during the pulling process is to be measured with an accuracy of ±3%.

Coefficient of Friction

The coefficient of friction is to be determined as follows:

$$\mu=[ln(S2/S1)]*(1/\alpha)$$

with μ=coefficient of friction ln=natural logarithm with basis e

S2=tensile force of the rope on the pull side

S1=tensile force of the rope on the weight side

α=wrap angle of the rope on the disc in radians

DETAILED DESCRIPTION OF THE FIGURES

Figure 1:
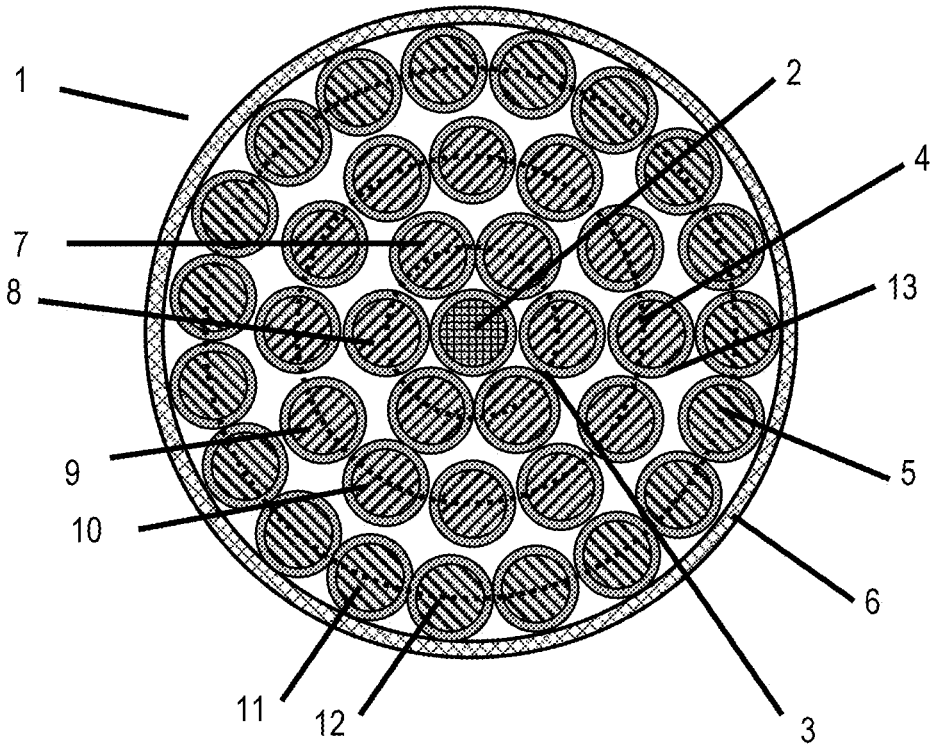
FIG. 1 shows a cross-section of a preferred embodiment of the rope according to the invention.

FIG. 1 shows a cross-section of a preferred embodiment of the rope 1 according to the invention.

Figure 2:
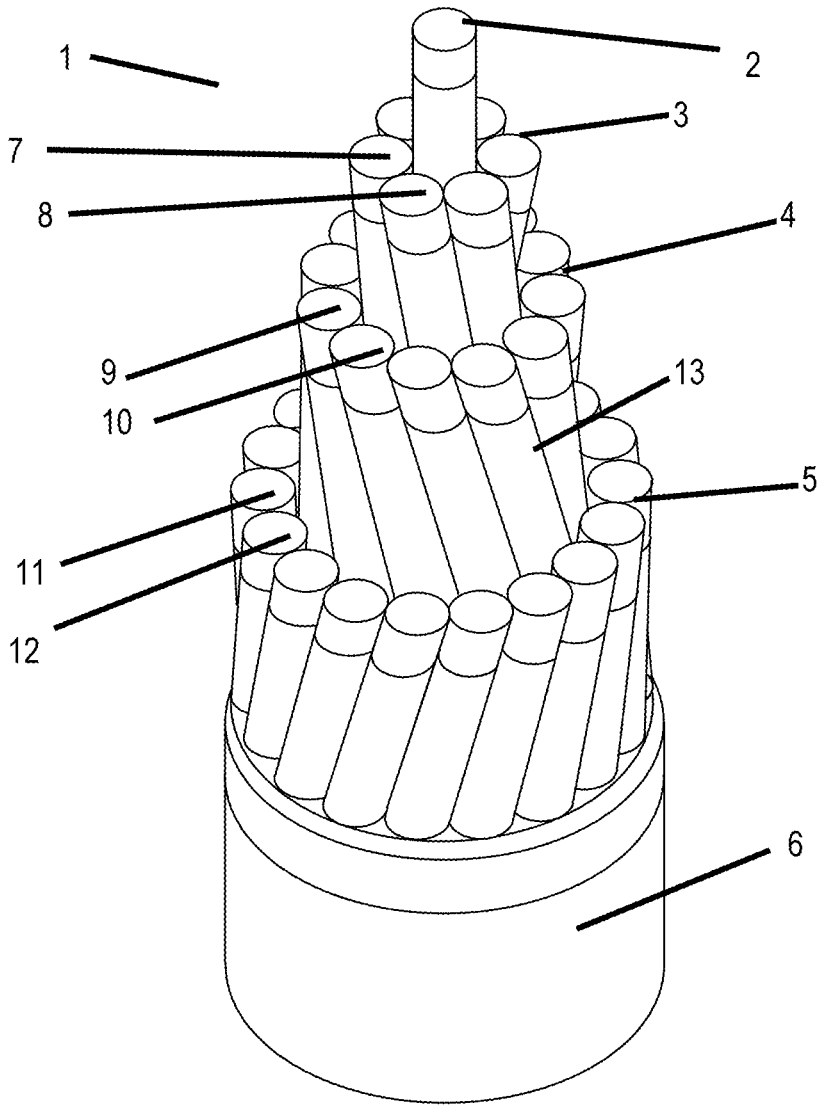
FIG. 2 shows a perspective view of a preferred embodiment of the rope according to the invention.

FIG. 2 shows a perspective view of the rope 1.

The rope 1 comprises a core 2 preferably made of textile fibre material. Three concentric strand layers 3, 4 and 5 are provided around the core 2, each consisting of several strands and being stranded with each other in the form of a spiral strand rope.

In the illustrated embodiment, the innermost strand layer 3 consists of 5 strands, of which, in the figure, two strands are indicated by reference numerals 7 and 8. The central strand layer 4 consists of 12 strands, of which, in the figure, two strands are indicated by reference numerals 9 and 10. The outermost strand layer 5 consists of 19 strands, of which, in the figure, two strands are indicated by reference numerals 11 and 12.

The fibre material of the strands essentially consists of high-strength synthetic fibres such as, e.g., UHMWPE fibres, aramide fibres, LCP fibres or PBO fibres.

Figure 3:
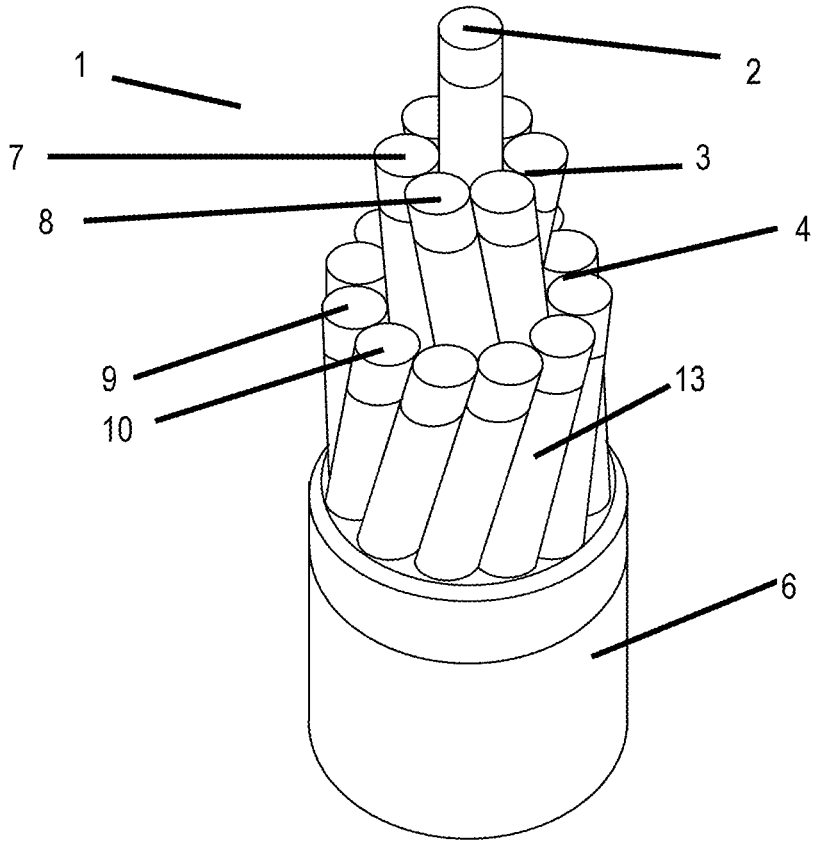
FIG. 3 shows a perspective view of a further preferred embodiment of the rope according to the invention.

In the illustrated embodiment, a sheath 6 is provided around the outermost strand layer 5. But also the outermost strand layer 5 can constitute the outermost ply of the rope. The sheath 6 has a coefficient of friction μ with respect to steel of μ<0.15 and is produced preferably from textile fibre material, e.g., UHMWPE. If no sheath 6 is provided, the fibre material of the outermost strand layer 5 has a correspondingly low coefficient of friction In the illustrated embodiment, all the strands 7, 8, 9, 10, 11, 12 as well as the core 2 are provided with a sheathing, which, in FIGS. 2 and 3, is indicated for a strand with reference numeral 13.

The strand layers 3, 4 and 5 are movable with respect to one another and also with respect to the core 2 and the sheath 6. Likewise, the individual strands 7, 8, 9, 10, 11, 12 are movable with respect to one another.

As can be seen especially in FIG. 2, in particular the outermost strand layer 5 and the central strand layer 4 are stranded with each other in the opposite lay direction.

The degree of filling of the rope with textile fibre material is 85% (which is not evident from the schematic illustrations of the figures).

The mutual ratio of the lengths of lay of the individual strand layers is not illustrated in the figures, but is preferably 1.0 or less, especially in case of the outermost strand layer (5) relative to the central strand layer (4).

FIG. 3 shows a perspective view of a rope 1 comprising merely two strand layers 3 and 4, with the structure otherwise being in line with that of the rope 1 illustrated in FIGS. 1 and 2.

The invention claimed is:

1. A rope made of textile fibre material, characterized by the combination of features whereby:

a) the load-bearing fibre material of the rope consists of high-strength synthetic fibres;
b) the rope is in the form of a spiral strand rope;
c) the rope has at least two concentric load-bearing strand layers;
d) the individual strands of the strand layers are movable with respect to one another;
e) the degree of filling of the rope with textile fibre material is ≥75%; and
f) the outermost ply of the rope has a coefficient of friction μ with respect to steel of μ<0.15.

2. A rope according to claim 1, characterized in that the rope is surrounded by a sheath, wherein the sheath has a coefficient of friction μ with respect to steel of μ<0.15.

3. A rope according to claim 1, characterized in that the strand layers are aligned with each other such that the rope is essentially non-twisting under load.

4. A rope according to claim 1, characterized in that the ratio of the length of lay of one of the strand layers to the length of lay of the strand layer adjacent in the direction of the rope centre is less than 1.5.

5. A rope according to claim 1, characterized in that the fibre material of the rope is compacted.

6. A rope according to claim 1, characterized in that the fibre material of the rope is stretched by more than 15% of its breaking force.

7. A rope according to claim 1, characterized in that the load-bearing strands of the rope are each provided individually with a sheathing.

8. A method of using the rope according to claim 1 comprising using the rope as a load rope for applications involving a drum drive.

9. A rope according to claim 1, characterized in that the rope has at least three concentric load-bearing strand layers.

10. A rope according to claim 1, characterized in that the degree of filling of the rope with textile fibre material is ≥85%.

11. A rope according to claim 4, characterized in that the ratio of the length of lay of one of the strand layers to the length of lay of the strand layer adjacent in the direction of the rope centre is 0.7 to 1.0.

12. A rope according to claim 4, characterized in that the ratio of the length of play of one of the strand layers to the length of lay of the strand layer adjacent in the direction of the rope centre is 0.8 to 0.9.

13. A rope according to claim 6, characterized in that the fibre material of the rope is stretched by 35% to 55% of its breaking force.

* * * * *